US011795757B2

(12) United States Patent
Estock

(10) Patent No.: US 11,795,757 B2
(45) Date of Patent: Oct. 24, 2023

(54) SNAP-LOCK GRID SYSTEM

(71) Applicant: CREATIVE MILLWORK OF OHIO, INC., Ashtabula, OH (US)

(72) Inventor: Brian Estock, Madison, OH (US)

(73) Assignee: CREATIVE MILLWORK OF OHIO, INC., Ashtabula, OH (US)

( * ) Notice: Subject to any disclaimer, the term of this patent is extended or adjusted under 35 U.S.C. 154(b) by 0 days.

(21) Appl. No.: 17/835,203

(22) Filed: Jun. 8, 2022

(65) Prior Publication Data

US 2022/0396990 A1 Dec. 15, 2022

Related U.S. Application Data

(60) Provisional application No. 63/210,109, filed on Jun. 14, 2021.

(51) Int. Cl.
*E06B 3/68* (2006.01)

(52) U.S. Cl.
CPC ..... *E06B 3/685* (2013.01)

(58) Field of Classification Search
CPC ..... E06B 3/6604; E06B 3/667; E06B 3/6675; E06B 3/685; E06B 3/99; Y10T 403/7194
See application file for complete search history.

(56) References Cited

U.S. PATENT DOCUMENTS 3,678,651 A * 7/1972 Hicks ..... E06B 3/685 52/456
4,060,950 A * 12/1977 Rackard ..... E06B 3/685 52/456
4,989,384 A * 2/1991 Kinghorn ..... E06B 3/667 52/456
2004/0216402 A1* 11/2004 Folsom ..... E06B 3/685 52/204.59
2008/0196345 A1* 8/2008 Hanggli ..... E06B 3/6604 52/456

FOREIGN PATENT DOCUMENTS

DE 2815948 A1 * 4/1978
EP 0050823 A1 * 5/1982

* cited by examiner

*Primary Examiner* — Christine T Cajilig
(74) *Attorney, Agent, or Firm* — Rankin, Hill & Clark LLP

(57) ABSTRACT

A muntin assembly for an associated window glass. The muntin assembly includes a first muntin bar that defines a first pocket and includes a first cleat. The muntin assembly also includes a second muntin bar that defines a second pocket and includes a second cleat. The muntin assembly also includes a clip disposed in the first pocket and the second pocket so as to hook the first muntin bar and the second muntin bar together in an overlapping arrangement. Further, the clip momentarily deforms to accept receipt of the first cleat and the second cleat.

20 Claims, 6 Drawing Sheets

SNAP-LOCK GRID SYSTEM

A window grille can be made up a collection of muntin bars (hereinafter "muntin assembly"). Further, these window grilles can be used to provide an enhanced appearance to a window, and hence the overall structure which houses the window.

The window grille can be utilized in a variety of applications, including, but not limited to top hung windows, bottom hung windows, side hung windows, and also doors. However, independent of where the window grille, and hence the muntin assembly, is placed, it is imperative that muntin bars be securely attached to one another. If the muntin bars are not securely attached to one another, difficulties can arise.

For example, the window can have a poor appearance and not enhance the look of the structure. Additionally, depending upon the degree of the improper attachment of the muntin bars, dimensional issues may occur. These dimensional issues could result in the muntin assembly, and hence the window grille, not remaining connected to the window. Separation of the muntin bars from one another or from the window could subsequently cause all or part of the window grille to become disengaged from the window. As will be appreciated, none of these results is a desirable outcome.

SUMMARY

In view of the foregoing, a muntin assembly for an associated window glass. The muntin assembly includes a first muntin bar that defines a first pocket and includes a first cleat. The muntin assembly also includes a second muntin bar that defines a second pocket and includes a second cleat. The muntin assembly also includes a clip disposed in the first pocket and the second pocket so as to hook the first muntin bar and the second muntin bar together in an overlapping arrangement. Further, the clip momentarily deforms to accept receipt of the first cleat and the second cleat.

DETAILED DESCRIPTION

Figure 1:
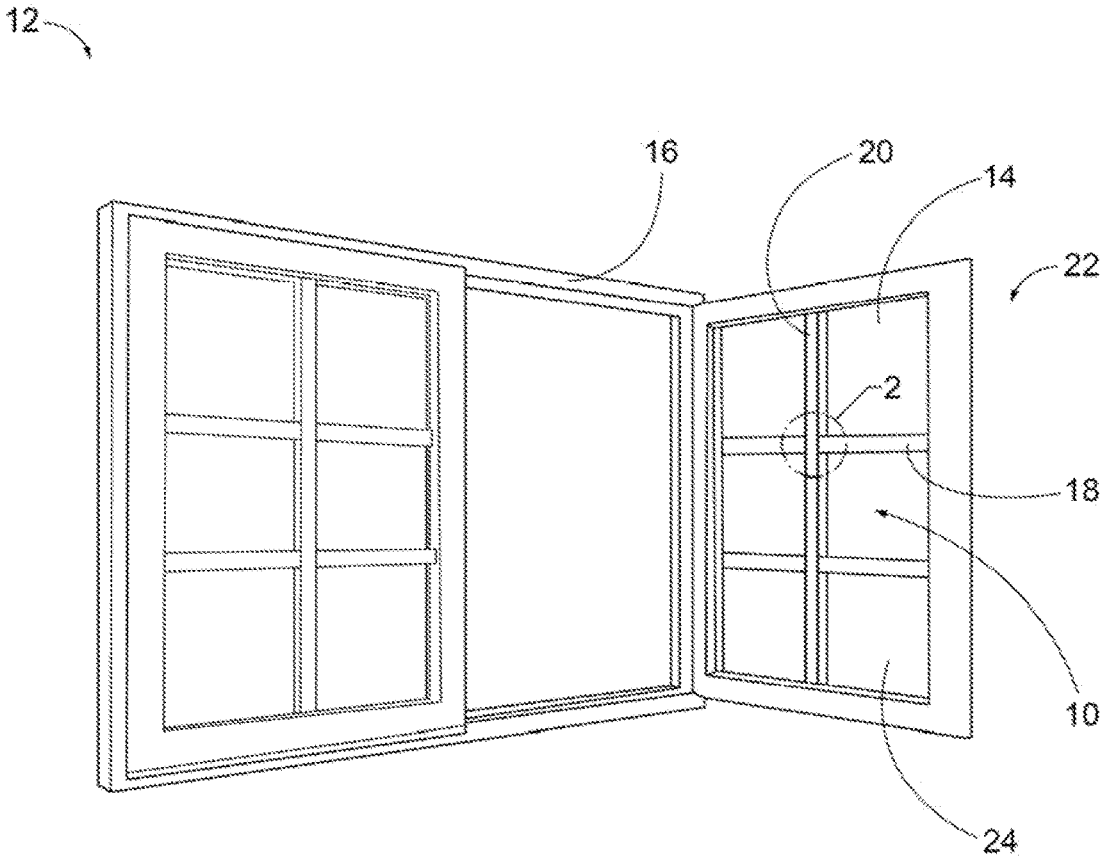
FIG. 1 is a perspective view of a window.
Figure 2:
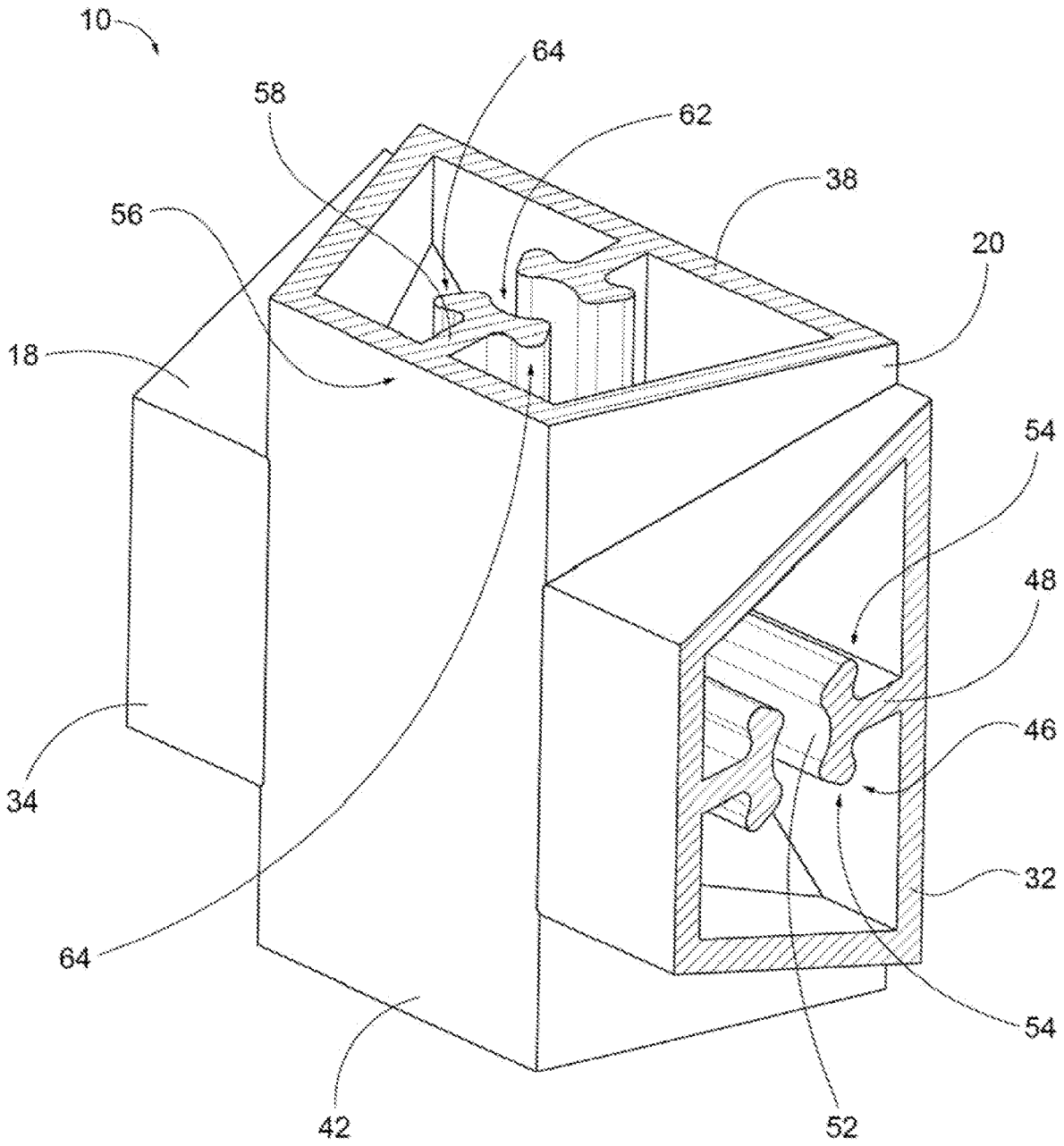
FIG. 2 is an enlarged partial perspective view of a muntin assembly (indicated as 2) of the window of FIG. 1.

With reference to FIG. 1, a muntin assembly 10 for a window 12 is shown. The window 12 can include at least one glass pane 14 that can be moveable within a window frame 16 that is connected to a structure (not shown). The muntin assembly 10 can include a first muntin bar 18 and a second muntin bar 20. The first muntin bar 18 and the second muntin bar 20 can visually separate glass in a standalone window or a window portion of a door (hereinafter collectively referred to as a "window").

A single first muntin bar 18 and a single second muntin bar 20 form the muntin assembly 10, whereas a collection of a plurality of first muntin bars and a plurality of second muntin bars make up a window grille 22 which divides the glass pane 14 into a grid arrangement of small panes of glass called lites 24. The window grille 22 can be used to provide an enhanced appearance to the window 12, and hence the overall structure which houses the window 12.

The window grille 22 may be placed on an outside-most surface of the glass pane 14 (i.e., exposed to the elements) on a single or multi-pane window 12. Further, the window grille 22 may be placed on an inside-most surface of the glass pane 14 (i.e., exposed to the interior of the structure) on a single or multi-pane window 12. Further still, the window grille 22 may be placed between two glass panes of a multi-pane window 12.

Figure 3A:
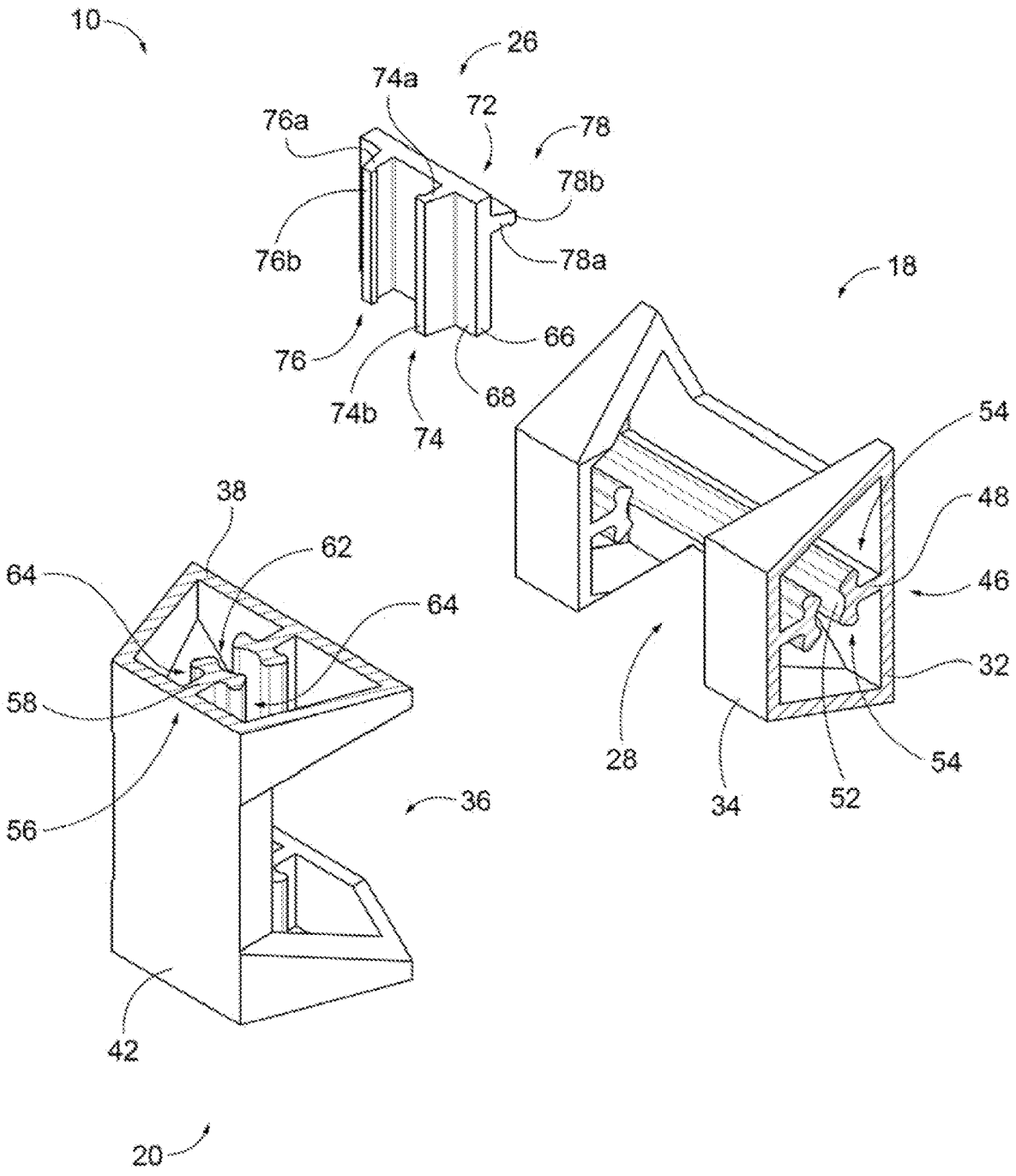
FIG. 3A is an exploded front perspective view of the muntin assembly of FIG. 2.
Figure 3B:
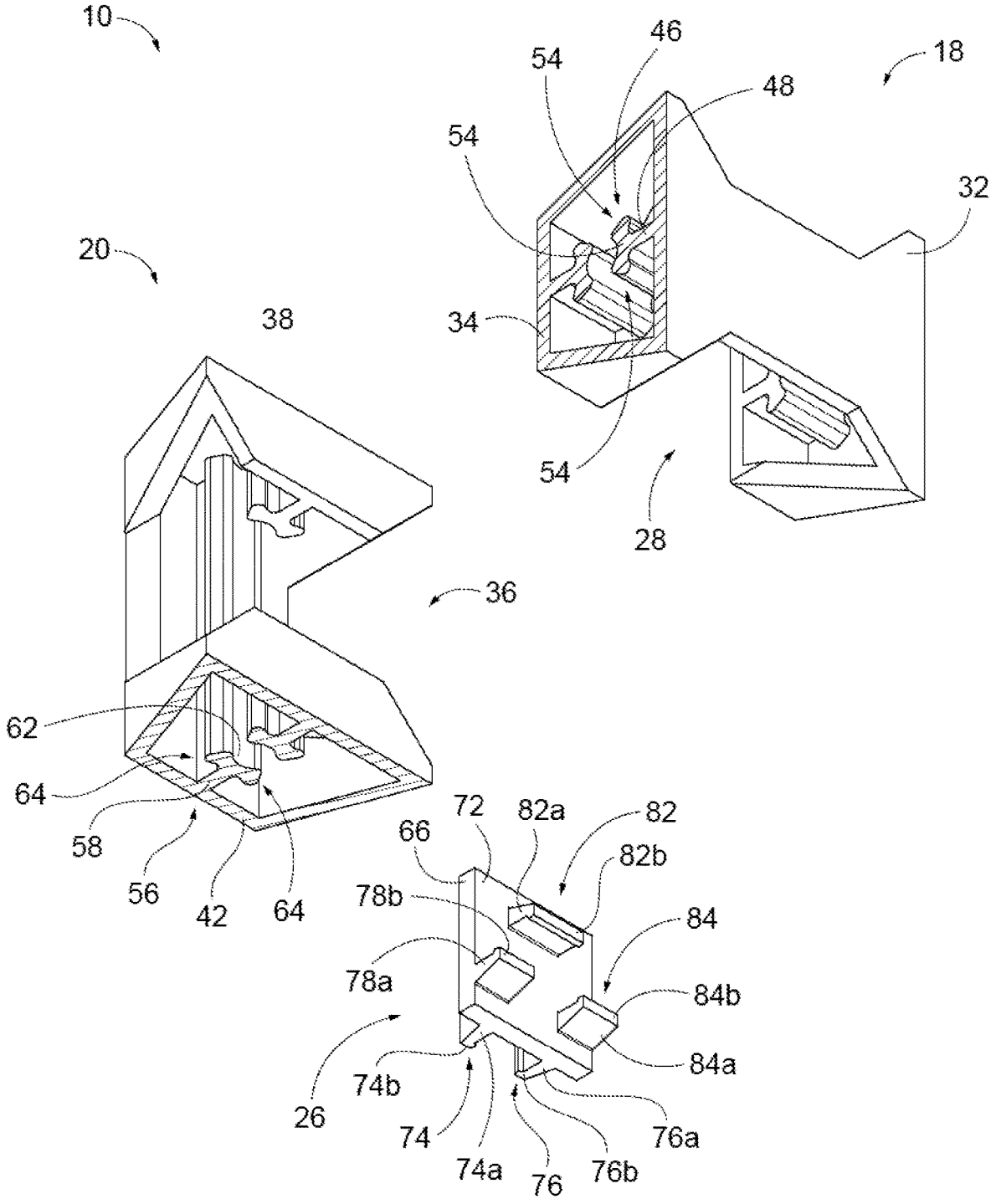
FIG. 3B is an exploded rear perspective view of the muntin assembly of FIG. 2.
Figure 4A:
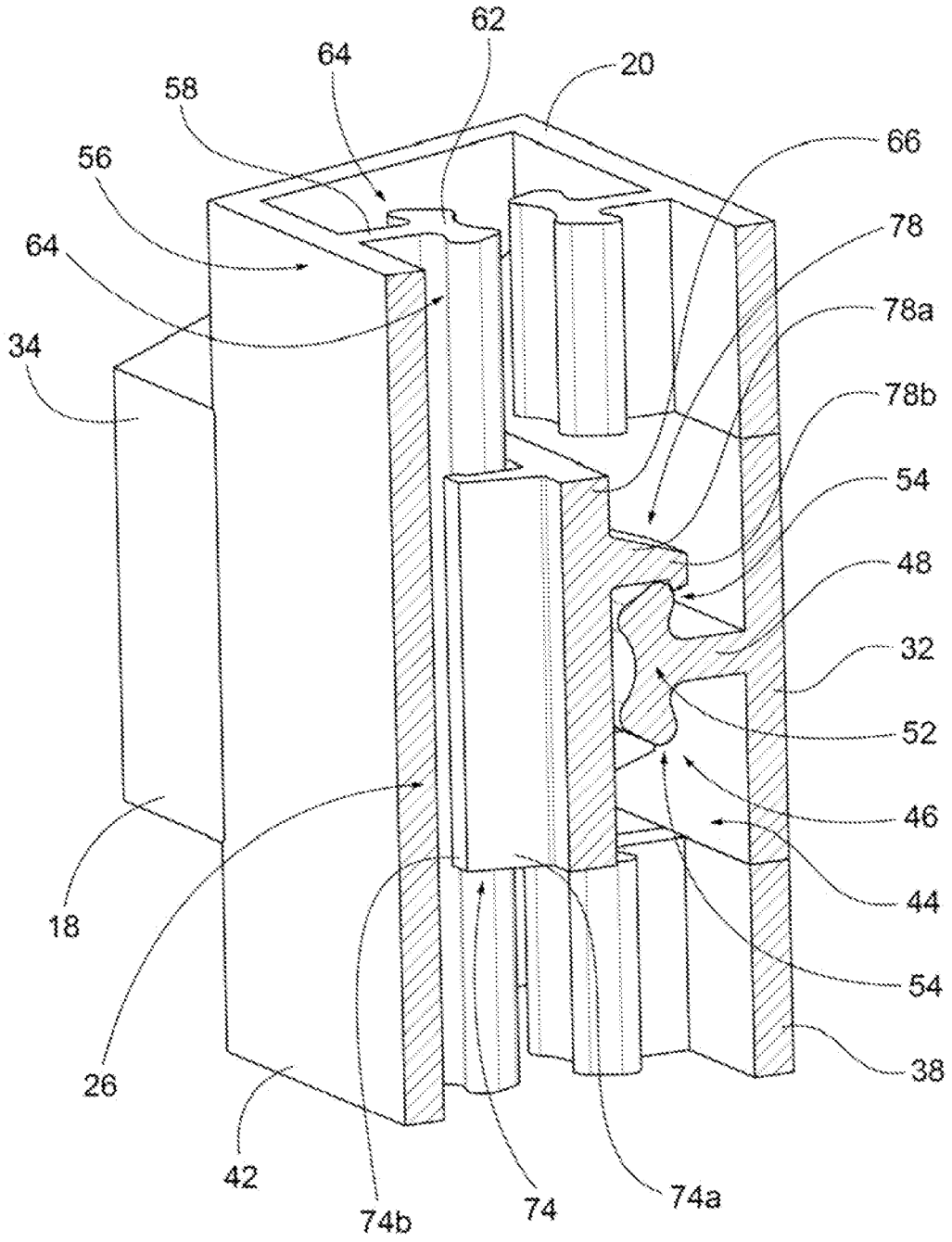
FIG. 4A is an elevational perspective sectional view of the muntin assembly of FIG. 2.
Figure 4B:
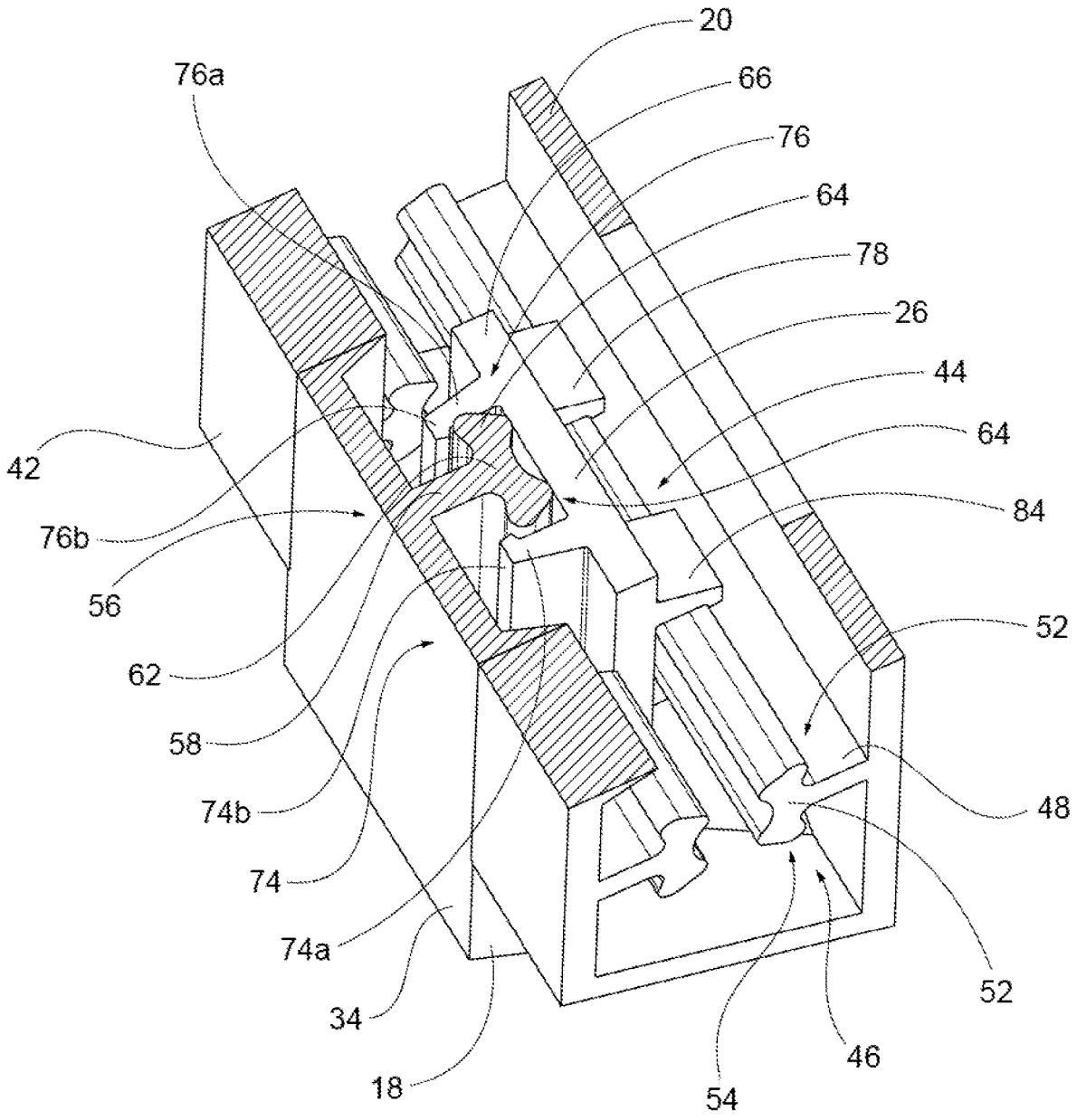
FIG. 4B is a plan perspective sectional view of the muntin assembly of FIG. 2.

It is also noted that the window grille 22 as will be described in more detail hereinafter can be utilized in a variety of applications, including, but not limited to top hung windows, bottom hung windows, side hung windows, and also doors. It is envisioned that the window 12 could include a plurality of muntin assemblies. Further still, it will be appreciated that any reference to FIG. 3 or FIG. 4 is applicable to FIGS. 3A/3B or FIGS. 4A/4B, respectively, unless otherwise noted.

As noted hereinbefore, the muntin assembly 10 includes the first muntin bar 18 and the second muntin bar 20. As shown in FIGS. 3-4, the muntin assembly 10 also includes a clip 26. The first muntin bar 18 defines a first pocket 28 and includes a first glass facing wall 32 that faces toward the associated window 12 glass and a first display wall 34 that faces in an opposite direction away from the first glass facing wall 32. The first glass facing wall 32 contacts, or nearly contacts, the glass pane 14 when the window grille 22 is installed with the glass pane 14.

The first display wall 34 is opposite the first glass facing wall 32 and can include design features to provide ornamental accent to the window grille 22. The second muntin bar 20 defines a second pocket 36 and includes a second glass facing wall 38 that faces toward the associated window 12 glass and a second display wall 42 that faces in an opposite direction away from the second glass facing wall 38. The second glass facing wall 38 contacts, or nearly contacts, the glass pane 14 when the window grille 22 is installed with the glass pane 14.

The second display wall 42 is opposite the second glass facing wall 38 and can include design features to provide ornamental accent to the window grille 22. These design features may be the same or different than the design features of the first display wall 34 of the first muntin bar 18. The first pocket 28 and the second pocket 36 cooperate to define a clip chamber 44 (FIG. 4) of the muntin assembly 10 that receives the clip 26 so that the clip 26 is completely surrounded by the first muntin bar 18 and the second muntin bar 20.

Further, the first muntin bar 18 is received in the second muntin bar 20 and the second muntin bar 20 is received in the first muntin bar 18 so that the first glass facing wall 32 of the first muntin bar 18 and the second glass facing wall 38 of the second muntin bar 20 share a common plane that is spaced from a plane shared by the first display wall 34 of the first muntin bar 18 and the second display wall 42 of the second muntin bar 20. The aforementioned arrangement provides numerous advantages. For example, the muntin assembly 10 has a clean look with the clip 26 being completely concealed from view. Further, the structural integrity of the muntin assembly 10 is improved.

The first muntin bar 18 can include a first cleat 46 that defines a first axis. The first cleat 46 can include a first pedestal 48 that extends from the first glass facing wall 32 toward the first display wall 34 and a first fin 52 that extends from the first pedestal 48 so as to be spaced from the first display wall 34 and the first glass facing wall 32 for engagement with the clip 26. The first fin 52 includes a first pair of lobes 54 disposed at opposite terminal ends of the first fin 52 for engagement with the clip 26. Further, a distance between the first pair of lobes 54 defines a first fin width.

The second muntin bar 20 includes a second cleat 56 that defines a second axis. During assembly of the clip 26 with the first muntin bar 18 and the second muntin bar 20, the clip 26 elastically deforms to engage the first cleat 46 and the second cleat 56 to securely hold the muntin assembly 10 together. During assembly of the muntin assembly 10, the clip 26 momentarily deforms to accept receipt of the first cleat 46 and the second cleat 56 as will be described in more detail hereinafter.

This momentary deformation of the clip 26 can also offer an audible cue to the assembler of the muntin assembly 10 to provide further confirmation that the first muntin bar 18 and the second muntin bar 20 are rigidly connected to one another. It is noted that this engagement between the first cleat 46 and the second cleat 56 with the clip 26 is quite robust and offers great resistance to separation of the first muntin bar 18 and the second muntin bar 20 from one another.

The first cleat 46 is disposed between the first glass facing wall 32 of the first muntin bar 18 and the second display wall 42 of the second muntin bar 20 so as to share an axis that is orthogonal to the first axis and the second axis. The second cleat 56 can include a second pedestal 58 that extends from the second display wall 42 toward the second glass facing wall 38 and a second fin 62 that extends from the second pedestal 58 so as to be spaced from the second display wall 42 and the second glass facing wall 38 for engagement with the clip 26.

The second fin 62 can include a second pair of lobes 64 disposed at opposite terminal ends of the second fin 62 for engagement with the clip 26. Further, a distance between the second pair of lobes 64 defines a second fin width. Notably, the first fin width is greater than a width of the first pedestal 48 and the second fin width is greater than a width of the second pedestal 58. Finally, the first fin width and the second fin width are equal to one another. This arrangement provides numerous advantages. For example, improved engagement between the first muntin bar 18, the second muntin bar 20, and the clip 26 is provided.

As illustrated, the first muntin bar 18 and the second muntin bar 20 are made of the same materials and have the same overall general shape as described hereinbefore. However, it will be appreciated that the first muntin bar 18 and the second muntin bar 20 could be different shapes than illustrated. Further, the first muntin bar 18 and the second muntin bar 20 could have shapes that are different from one another without departing from the scope of this disclosure. Additionally, the first muntin bar 18, the second muntin bar 20, and the clip 26 could be made of any numbers of materials and by a variety of processes.

Also, these materials and processes could be different from one another for each of the muntin assembly 10. For example, the first muntin bar 18 and the second muntin bar 20 can be pieces of wood, metal, and/or polymer. Furthermore, the first muntin bar 18 and the second muntin bar 20 could be a metal material made by an extrusion process and the clip 26 could be a polymer material made by injection molding. However, other materials and construction techniques are envisioned. For example, it is envisioned that all or part of the muntin assembly 10 could be made by additive manufacturing (also known as 3-D printing).

The clip 26 is disposed in the first pocket 28 and the second pocket 36 so as to hook the first muntin bar 18 and the second muntin bar 20 together in an overlapping arrangement. Further, the first muntin bar 18 and the second muntin bar 20 slidingly engage one another so as to be retained to one another solely by the clip 26. The clip 26 may engage the first muntin bar 18 and the second muntin bar 20 simultaneously or individually.

However, it will be understood that the clip 26 engages both the first muntin bar 18 and the second muntin bar 20 for the first muntin bar 18 and the second muntin bar 20 to maximize attachment to one another. Due to the close tolerances and fit between the first muntin bar 18 and the second muntin bar 20 when they are received in each other, the axial movement of the clip 26 is minimized. It is envisioned that the clip 26 and/or the muntin bars 18, 20 could include additional features which would further limit the axial movement of the clip 26 with respect to the muntin bars.

The clip 26 includes a base 66 that defines a base plane that is generally parallel to the first glass facing wall 32, the first display wall 34, the second glass facing wall 38, and the second display wall 42 when the clip 26 is received by the first muntin bar 18 and the second muntin bar 20 such that the base 66 is between the first glass facing wall 32 and the second display wall 42 so as to share an axis that is orthogonal to the first axis and the second axis.

The base 66 of the clip 26 can include a first side 68 and a second side 72, where the first side 68 of the base 66 and the second side 72 of the base 66 face in opposite directions from one another. A first hook 74 and a second hook 76 can extend from the first side 68 of the base 66. Further, a third hook 78, a fourth hook 82, and a fifth hook 84 can extend from the second side 72 of the base 66.

The first hook 74 can include a first shank **74*a* and a first barb 74*b*. The first shank 74*a* extends along the base 66 in a direction that is parallel to the first axis so as to define a first shank length. The first shank 74*a* can also extend from the base 66 so as to define a first shank height. The first barb 74*b* can extend from the first shank 74*a*** so as to define a first barb width.

The first hook 74 and the second hook 76 of the clip 26 cooperate to grip the first cleat 46 of the first muntin bar 18. The second hook 76 can include a second shank **76*a* and a second barb 76*b*. The second shank 76*a* extends along the base 66 in a direction that is parallel to the first axis so as to define a second shank length. Additionally, the second shank 76*a* extends from the base 66 so as to define a second shank height. The second barb 76*b* extends from the second shank 76*a* so as to define a second barb width. Notably, the first shank height is greater than the second barb width. This arrangement further improves the engagement between the muntin bars 18, 20 and the clip 26**.

The third hook 78 can include a third shank **78*a* and a third barb 78*b*. The third shank 78*a* extends along the base 66 in a direction that is parallel to the second axis so as to define a third shank length. Further, the third shank 78*a* extends from the base 66 so as to define a third shank height. It is noted that the second shank length is greater than the third shank length. The third barb 78*b* extends from the third shank 78*a* so as to define a third barb width. The third shank height is greater than the second barb 76*b* width, helping to further improve the engagement between the muntin bars 18, 20 and the clip 26**.

The third hook 78 and the fourth hook 82 cooperate to grip the second cleat 56 of the second muntin bar 20. The fourth hook 82 includes a fourth shank 82*a* and a fourth barb 82*b*. The fourth shank 82*a* extends along the base 66 in a direction that is parallel to the second axis so as to define a fourth shank length. The third shank length and the first shank length are each greater than the fourth shank length.

The fourth shank 82*a* extends from the base 66 so as to define a fourth shank height. The fourth barb 82*b* extends from the fourth shank 82*a* so as to define a fourth barb width. It is also noted that the clip 26 is received between the first muntin bar 18 and the second muntin bar 20 such that the first hook 74 and the second hook 76 of the clip 26 grip the first fin 52 of the first cleat 46 and the third hook 78 and the fourth hook 82 of the clip 26 grip the second fin 62 of the second cleat 56, thereby providing a sturdy connection for the muntin assembly 10.

The fourth hook 82 and the fifth hook 84 share a common engagement axis such that the fourth hook 82 and the fifth hook 84 are disposed on a side of the second cleat 56 and the third hook 78 is disposed on another side of the second cleat 56 that is different than the side that the fourth hook 82 and the fifth hook 84 are disposed, thereby improving ease of assembly for the muntin assembly 10. The fifth hook 84 includes a fifth shank 84*a* and a fifth barb 84*b*.

The fifth shank 84*a* extend along the base 66 in a direction that is parallel to the second axis so as to define a fifth shank length and extends from the base 66 so as to define a fifth shank height. A sum of the fourth shank length and the fifth shank length is less than the first shank length. The fifth barb 84*b* extends from the fifth shank 84*a* so as to define a fifth barb width. This layout helps to further provide a sturdy connection between the muntin bars 18, 20 and the clip 26.

Thus, when the first muntin bar 18 and the second muntin bar 20 are joined together with the clip 26, a distance between the first barb 74*b* of the first hook 74 and the second barb 76*b* of the second hook 76 is momentary increased to allow receipt of the first cleat 46. In particular, after the first pair of lobes 54 of the first fin 52 of the first cleat 46 are received by the clip 26 (i.e., inserted toward the base 66), the distance between the first barb 74*b* of the first hook 74 and the second barb 76*b* of the second hook 76 can return to the distance that it was prior to the insertion of the first cleat 46. It is during this insertion of the first cleat 46 into the clip 26 that an audible signal may be present. Further, tactile feedback in the form of a "click" may be felt by the assembler of the muntin assembly 10.

Furthermore, when the first muntin bar 18 and the second muntin bar 20 are joined together with the clip 26, a distance between the third barb 78*b* of the third hook 78 and the fourth barb 82*b* of the fourth hook 82 is momentary increased to allow receipt of the second cleat 56. In particular, after the second pair of lobes 64 of the second fin 62 of the second cleat 56 are received by the clip 26 (i.e., inserted toward the base 66), the distance between the third barb 78*b* of the third hook 78 and the fourth barb 82*b* of the fourth hook 82 can return to the distance that it was prior to the insertion of the second cleat 56. Optionally, the fifth hook 84 may be present on the clip 26. When the fifth hook 84 is present, the operation of the fifth hook 84 will mirror the movement of the fourth hook 82 to aid in retention of the second cleat 56 in cooperation with the third hook 78. It is during this insertion of the second cleat 56 into the clip 26 that an audible signal may be present. Further, tactile feedback in the form of a "click" may be felt by the assembler of the muntin assembly 10.

A muntin assembly has been described above with particularity. Modifications and alterations will occur to those upon reading and understanding the preceding detailed description. The invention, however, is not limited to only the embodiments described above. Instead, the invention is broadly defined by the appended claims and the equivalents thereof.

Moreover, it will be appreciated that variations of the above-disclosed and other features and functions, or alternatives or varieties thereof, may be desirably combined into many other different systems or applications. Also, that various presently unforeseen or unanticipated alternatives, modifications, variations or improvements therein may be subsequently made by those skilled in the art which are also intended to be encompassed by the following claims.

The invention claimed is:

1. A muntin assembly for an associated window glass, the muntin assembly comprising:

a first muntin bar defining a first pocket, wherein the first muntin bar includes a first cleat;

a second muntin bar defining a second pocket, wherein the second muntin bar includes a second cleat, and wherein the first muntin bar is received in the second muntin bar and the second muntin bar is received in the first muntin bar; and a clip disposed in the first pocket and the second pocket so as to hook the first muntin bar and the second muntin bar together in an overlapping arrangement, wherein the clip momentarily deforms to accept receipt of the first cleat and the second cleat.

2. The muntin assembly of claim 1, wherein the first muntin bar includes a first glass facing wall that faces toward the associated window glass and a first display wall that faces in an opposite direction away from the first glass facing wall and the second muntin bar includes a second glass facing wall that faces toward the associated window glass and a second display wall that faces in an opposite direction away from the second glass facing wall, and wherein the first glass facing wall of the first muntin bar and the second glass facing wall of the second muntin bar share a common plane that is spaced from a plane shared by the first display wall of the first muntin bar and the second display wall of the second muntin bar.

3. The muntin assembly of claim 2, wherein the first cleat defines a first axis and the second cleat defines a second axis, and wherein the first cleat is disposed between the first glass facing wall of the first muntin bar and the second display wall of the second muntin bar so as to share an axis that is orthogonal to the first axis and the second axis.

4. The muntin assembly of claim 2, wherein the first cleat defines a first axis and the second cleat defines a second axis, and wherein the clip includes a base that defines a base plane that is generally parallel to the first glass facing wall, the first display wall, the second glass facing wall, and the second display wall when the clip is received by the first muntin bar and the second muntin bar such that the base is between the first glass facing wall and the second display wall so as to share an axis that is orthogonal to the first axis and the second axis.

5. The muntin assembly of claim 2, wherein the first cleat defines a first axis and the second cleat defines a second axis, wherein the first cleat includes a first pedestal that extends from the first glass facing wall toward the first display wall and the second cleat includes a second pedestal that extends from the second display wall toward the second glass facing wall, and wherein the first cleat includes a first fin that extends from the first pedestal so as to be spaced from the first display wall and the first glass facing wall for engagement with the clip and the second cleat includes a second fin that extends from the second pedestal so as to be spaced from the second display wall and the second glass facing wall for engagement with the clip.

6. The muntin assembly of claim 5, wherein the clip is received between the first muntin bar and the second muntin bar such that a first hook of the clip and a second hook of the clip grip the first fin of the first cleat and a third hook of the clip and a fourth hook of the clip grip the second fin of the second cleat.

7. The muntin assembly of claim 5, wherein the first fin includes a first pair of lobes disposed at opposite terminal ends of the first fin for engagement with the clip and the second fin includes a second pair of lobes disposed at opposite terminal ends of the second fin for engagement with the clip.

8. The muntin assembly of claim 7, wherein a distance between the first pair of lobes defines a first fin width and a distance between the second pair of lobes defines a second fin width, and wherein the first fin width is greater than a width of the first pedestal and the second fin width is greater than a width of the second pedestal.

9. The muntin assembly of claim 8, wherein the first fin width and the second fin width are equal to one another.

10. A muntin assembly for an associated window glass, the muntin assembly comprising:

a first muntin bar defining a first pocket, wherein the first muntin bar includes a first cleat;

a second muntin bar defining a second pocket, wherein the second muntin bar includes a second cleat; and a clip disposed in the first pocket and the second pocket so as to hook the first muntin bar and the second muntin bar together in an overlapping arrangement, wherein the clip momentarily deforms to accept receipt of the first cleat and the second cleat, wherein the clip includes a base with a first side from which a first hook and a second hook extend and a second side from which a third hook and a fourth hook extend, the first side of the base and the second side of the base facing in opposite directions from one another, and wherein the first hook and the second hook of the clip cooperate to grip the first cleat of the first muntin bar, and the third hook and the fourth hook of the clip cooperate to grip the second cleat of the second muntin bar.

11. The muntin assembly of claim 10, wherein a fifth hook extends from the second side, and wherein the fourth hook and the fifth hook share a common engagement axis such that the fourth hook and the fifth hook are disposed on a side of the second cleat and the third hook is disposed on another side of the second cleat that is different than the side that the fourth hook and the fifth hook are disposed.

12. The muntin assembly of claim 10, wherein the first hook includes a first shank and a first barb, the first shank extending from the base so as to define a first shank height and the first barb extending from the first shank so as to define a first barb width and the second hook includes a second shank and a second barb, the second shank extending from the base so as to define a second shank height and the second barb extending from the second shank so as to define a second barb width, and wherein the first shank height is greater than the second barb width.

13. The muntin assembly of claim 12, wherein the third hook includes a third shank and a third barb, the third shank extending from the base so as to define a third shank height and the third barb extending from the third shank so as to define a third barb width and the fourth hook includes a fourth shank and a fourth barb, the fourth shank extending from the base so as to define a fourth shank height and the fourth barb extending from the fourth shank so as to define a fourth barb width, wherein the clip also includes a fifth hook that includes a fifth shank and a fifth barb, the fifth shank extending from the base so as to define a fifth shank height and the fifth barb extending from the fifth shank so as to define a fifth barb width, and wherein the third shank height is greater than the second barb width.

14. The muntin assembly of claim 13, wherein the first cleat defines a first axis and the second cleat defines a second axis, the third shank extending along the base in a direction that is parallel to the second axis so as to define a third shank length and the fourth shank extending along the base in a direction that is parallel to the second axis so as to define a fourth shank length, and wherein the third shank length is greater than the fourth shank length.

15. The muntin assembly of claim 13, wherein the first cleat defines a first axis and the second cleat defines a second axis, the first shank extending along the base in a direction that is parallel to the first axis so as to define a first shank length and the fourth shank extending along the base in a direction that is parallel to the second axis so as to define a fourth shank length, and wherein the first shank length is greater than the fourth shank length.

16. The muntin assembly of claim 13, wherein the first cleat defines a first axis and the second cleat defines a second axis, the second shank extending along the base in a direction that is parallel to the first axis so as to define a second shank length and the third shank extending along the base in a direction that is parallel to the second axis so as to define a third shank length, and wherein the second shank length is greater than the third shank length.

17. The muntin assembly of claim 13, wherein the first cleat defines a first axis and the second cleat defines a second axis, the first shank extending along the base in a direction that is parallel to the first axis so as to define a first shank length and the fourth shank and the fifth shank each extending along the base in a direction that is parallel to the second axis so as to define a fourth shank length and a fifth shank length, respectively, and wherein a sum of the fourth shank length and the fifth shank length is less than the first shank length.

18. The muntin assembly of claim 1, wherein the first muntin bar and the second muntin bar slidingly engage one another so as to be retained to one another solely by the clip.

19. The muntin assembly of claim 1, wherein the first pocket and the second pocket cooperate to define a clip chamber of the muntin assembly that receives the clip so that the clip is completely surrounded by the first muntin bar and the second muntin bar.

20. The muntin assembly of claim 10, wherein the first muntin bar and the second muntin bar slidingly engage one another so as to be retained to one another solely by the clip.

* * * * *